US010124481B2

(12) United States Patent
Malone

(10) Patent No.: US 10,124,481 B2
(45) Date of Patent: Nov. 13, 2018

(54) COLLAPSIBLE AND ADJUSTABLE RISER FOR AUTOMOTIVE USE

(71) Applicant: Bryan C. Malone, Hooper, UT (US)

(72) Inventor: Bryan C. Malone, Hooper, UT (US)

( * ) Notice: Subject to any disclaimer, the term of this patent is extended or adjusted under 35 U.S.C. 154(b) by 45 days.

(21) Appl. No.: 15/132,549

(22) Filed: Apr. 19, 2016

(65) Prior Publication Data

US 2016/0303733 A1 Oct. 20, 2016

Related U.S. Application Data

(60) Provisional application No. 62/150,097, filed on Apr. 20, 2015.

(51) Int. Cl.
*B25H 5/00* (2006.01)

(52) U.S. Cl.
CPC ..... *B25H 5/00* (2013.01)

(58) Field of Classification Search
CPC .... B25H 5/00; E04G 7/06; E04G 7/14; E04G 1/02; E04G 1/04; E04G 1/06; E04G 1/15; E04G 5/142
USPC ..... 312/205; 182/151
See application file for complete search history.

(56) References Cited

U.S. PATENT DOCUMENTS 3,131,784 A * 5/1964 Jackson ..... E04G 5/04 182/229
3,282,378 A * 11/1966 Pierce ..... E04G 3/30 182/113
4,025,137 A * 5/1977 Wyler ..... A47B 45/00 108/93
4,620,612 A * 11/1986 Enoki ..... B63C 5/02 182/113
4,911,264 A * 3/1990 McCafferty ..... B60R 3/007 182/150
5,335,753 A * 8/1994 Campbell ..... B25H 1/06 182/151
5,476,282 A * 12/1995 Dahl ..... B62B 1/002 280/47.18
5,536,034 A * 7/1996 Miller ..... B62B 1/002 108/11
D372,822 S * 8/1996 O'Brien ..... D6/513
5,878,839 A * 3/1999 Lin ..... B25H 1/10 182/153
5,893,617 A * 4/1999 Lee ..... A47B 47/0041 108/158.13
5,921,646 A * 7/1999 Hwang ..... F16B 5/0642 312/249.8

(Continued)

*Primary Examiner* — Katherine W Mitchell
*Assistant Examiner* — Shiref M Mekhaeil
(74) *Attorney, Agent, or Firm* — Ramey & Schwaller, LLP

(57) ABSTRACT

The present disclosure is directed to risers for automotive repair and to related methods and systems. In a first illustrative embodiment, a generally U-shaped riser is formed from two boxes each having a generally L shape. A latitudinal portion of the riser is formed from the adjustable joining of the two boxes, with the remainder of the L-shaped portions disposed in an orthogonal direction. A vehicle may be positioned within the U-shaped riser and the two boxes adjusted to place the riser adjacent the vehicle. When not in use, the riser may be reduced to a minimum space position and stored. The riser may be formed from a number of smaller components, such as planar members or metal framing, allowing it to be taken apart for longer storage or for ease of shipping.

18 Claims, 10 Drawing Sheets

(56) References Cited

U.S. PATENT DOCUMENTS 5,937,613 A * 8/1999 Vess, Sr. ..... B25H 7/00 33/42
5,971,165 A * 10/1999 Levins ..... A47B 65/00 211/43
6,079,941 A * 6/2000 Lee ..... B62B 3/04 16/35 R
6,786,503 B1 * 9/2004 Young ..... B62B 3/008 280/35
8,833,581 B2 * 9/2014 Kuo ..... B65D 21/086 220/4.28
9,016,485 B1 * 4/2015 Liu ..... A47B 47/0075 211/183
9,220,341 B2 * 12/2015 Dart ..... A47B 45/00
2001/0052505 A1 * 12/2001 Lee ..... F25D 25/00 211/85.18
2002/0105169 A1 * 8/2002 Dahl ..... B62B 1/002 280/651
2003/0136751 A1 * 7/2003 Rosenberg ..... A47B 46/00 211/175
2004/0088845 A1 * 5/2004 Winkenbach ..... B25H 1/0014 29/281.5
2005/0103569 A1 * 5/2005 Winter ..... E04G 1/15 182/223
2006/0207957 A1 * 9/2006 Chen ..... A47B 47/0025 211/188
2007/0296168 A1 * 12/2007 Dahl ..... B60B 3/001 280/47.35
2009/0308689 A1 * 12/2009 Johnson ..... A01M 31/02 182/113
2010/0012430 A1 * 1/2010 Ogden ..... E04G 1/02 182/141
2011/0036735 A1 * 2/2011 Cho ..... A45C 13/36 206/349
2012/0223038 A1 * 9/2012 Bean ..... A47B 96/021 211/90.01
2013/0075194 A1 * 3/2013 Hagberg ..... E04G 5/067 182/113
2014/0318891 A1 * 10/2014 Crothers ..... E04G 5/14 182/113
2015/0226002 A1 * 8/2015 Johansen ..... E06C 9/02 182/217
2015/0352712 A1 * 12/2015 Harrison ..... B25H 3/02 206/349

* cited by examiner

COLLAPSIBLE AND ADJUSTABLE RISER FOR AUTOMOTIVE USE

CROSS REFERENCE TO RELATED APPLICATIONS

This application claims priority to and incorporates by reference all of the subject matter included in Provisional Patent Application Ser. No. 62/150,097, which was filed Apr. 20, 2015.

TECHNICAL FIELD

The present disclosure relates to a collapsible and adjustable riser for use in automotive repair.

BACKGROUND

In order to repair a vehicle, especially a tall vehicle like a pickup truck, it is often necessary to use a step stool in order to reach the various components. This can add additional complexity to a job as the stools need to be moved to different positions for use during different parts of a repair, or for different personnel.

A system or device that provided a continuous raised area allowing one or more users to move around the front of a vehicle to perform a repair would be an improvement in the art. Such a system or device that was adjustable for use with different vehicles and could be collapsed for storage when not in use would be a further improvement in the art.

SUMMARY

The present disclosure is directed to risers for automotive repair and to related methods and systems. In a first illustrative embodiment, a generally U-shaped riser is formed from two boxes each having a generally L shape. A latitudinal portion of the riser is formed from the adjustable joining of the two boxes, with the remainder of the L-shaped portions disposed in an orthogonal direction. A vehicle may be positioned within the U-shaped riser and the two boxes adjusted to place the riser adjacent the vehicle. When not in use, the riser may be reduced to a minimum space position and stored. The riser may be formed from a number of smaller components, such as planar members or metal framing, allowing it to be taken apart for longer storage or for ease of shipping.

DESCRIPTION OF THE DRAWINGS

It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, to the several drawings, and to the attached Appendix.

DETAILED DESCRIPTION

The present disclosure relates to apparatus, systems and methods related to adjustable risers for automotive repair. It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure. It will be further appreciated that differently sized components may be used for different embodiments as needed for particular uses.

Figure 1:
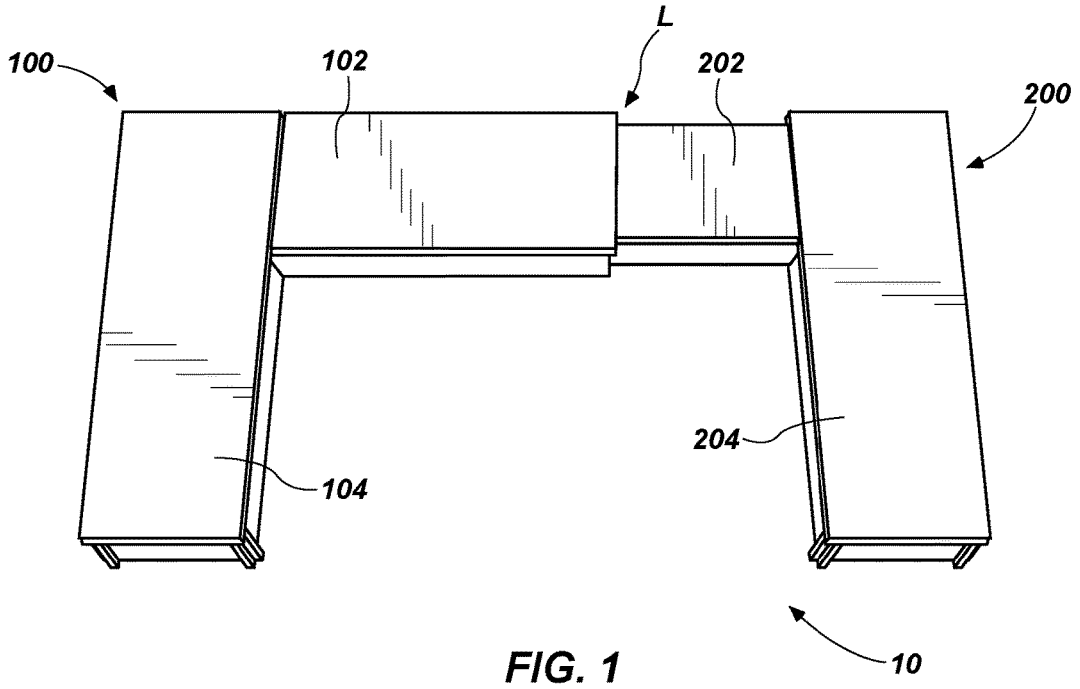
FIG. 1 is a top perspective photograph of a first embodiment of a riser in accordance with this disclosure in an assembled position.
Figure 2:
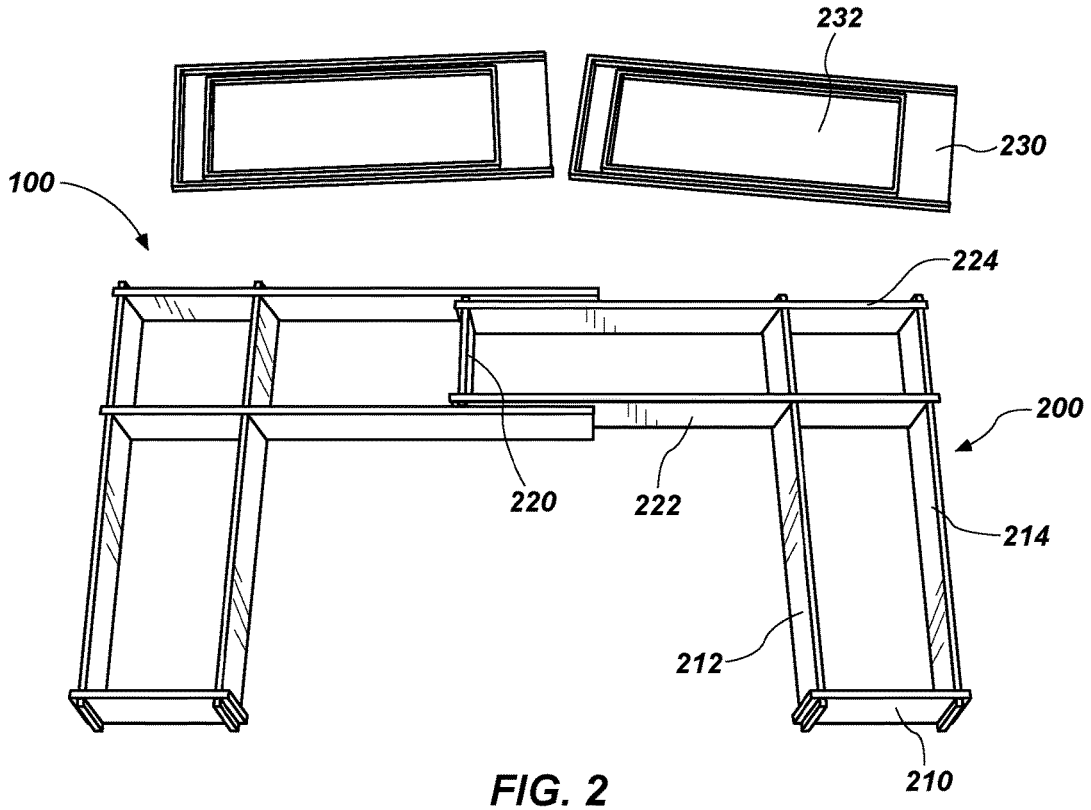
FIG. 2 is a top perspective photograph of the embodiment of FIG. 1 with the top caps of the riser boxes removed to show the internal components.

Turning to FIGS. 1 and 2, a first embodiment of a riser system 10 for automotive repair is depicted. The generally U-shaped riser system 10 is formed from two generally L-shaped boxes 100 and 200. A latitudinal portion L of the riser system 10 is formed from the adjustable joining of the latitudinal portions 102 and 202 of the two boxes 100 and 200 with the remaining longitudinal portions 104 and 204 of the Ls disposed in an orthogonal direction.

As best depicted in FIG. 2, the adjustable joining allows the length of the latitudinal portion L to be adjusted. This may be accomplished by having the one box 100 feature a latitudinal portion 102 with an open end, into which the latitudinal portion 202 of the second box 200 may be inserted in a close fit. Boxes 100 and 200 may then be slidably adjusted with respect to one another to alter the length of latitudinal portion L. As depicted, the end of the second latitudinal portion 202 may be closed for additional support.

A vehicle may be positioned within the U-shaped riser system 10 and the two boxes 100 and 200 adjusted to place the riser system 10 adjacent the vehicle. Users may then stand or walk on top of the riser system to reach vehicle components, such as into the engine compartment to service the vehicle.

When not in use, the riser system 10 may be reduced to a minimum space position by moving the boxes 100 and 200 towards one another until the latitudinal portion L is adjusted to the smallest possible length. The riser system 10 may then be tipped onto the sidewall of a longitudinal portion 104 or 204. In a service bay, it could then be easily moved against a wall or into a storage area.

Figure 3:
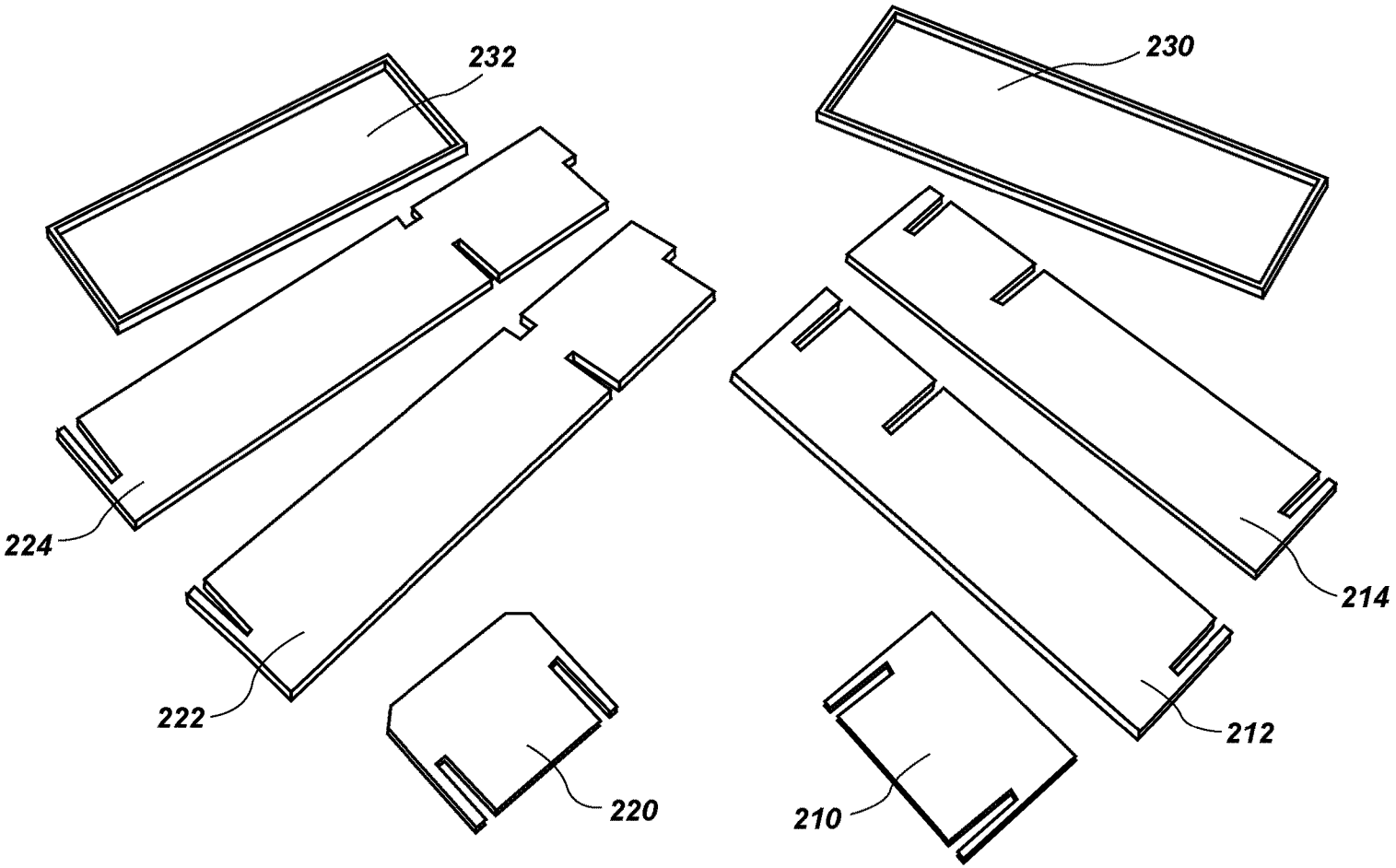
FIG. 3 is a top view of the components of one box of the system of FIGS. 1 and 2 in an unassembled form.
Figure 4:
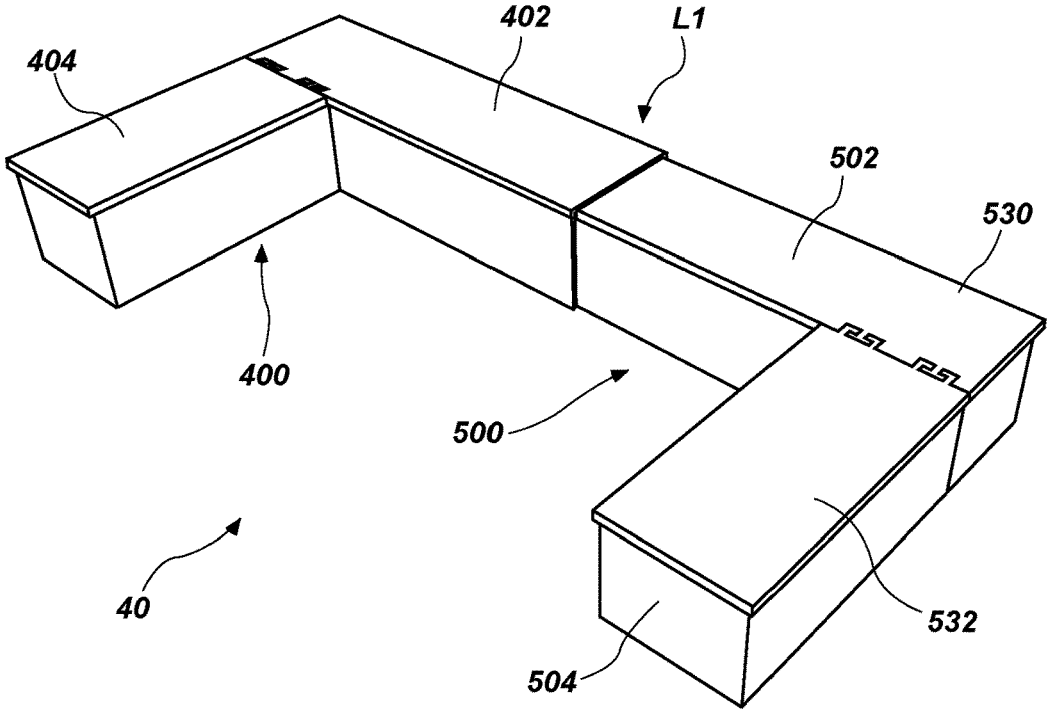
FIG. 4 is a top perspective view of a second embodiment of a riser in accordance with this disclosure in an assembled position.

As depicted in FIGS. 2 and 3, each box 100 or 200 of the riser system 10 may be formed from a number of planar components, allowing it to be taken apart for longer storage or for ease of shipping. In the depicted embodiment, box 200 is formed from eight different components. An underlaying support frame is formed interconnecting pieces that form the sidewalls of the box 200. These may connect by corresponding slots allowing the pieces to be inserted together. A longitudinal end cap 210 may be attached to two longitudinal side wall pieces 212 and 214, which are then connected to two latitudinal sidewall portions 222 and 224, the other end of which may be closed by a latitudinal end cap 220. A longitudinal top cap 230 and latitudinal top cap 232 may then be placed over the support frame. The top caps 230 and 232 may be recessed or have an external lip to retain them in position when placed over the box frame. Box 100 may be similarly formed, with the omission of a latitudinal end cap.

Turning to FIGS. 4 through 8, a second embodiment of a riser system 40 for automotive repair is depicted. The generally U-shaped riser system 40 is formed from two generally L-shaped boxes 400 and 500. A latitudinal portion L1 of the riser system 40 is formed from the adjustable joining of the latitudinal portions 402 and 502 of the two boxes 400 and 500 with the remaining longitudinal portions 404 and 504 of the Ls disposed in an orthogonal direction.

The adjustable joining allows the length of the latitudinal portion L1 to be adjusted. This may be accomplished by having the first box 400 feature a latitudinal portion 402 with an open end, into which the latitudinal portion 502 of the second box 500 may be inserted in a close fit. Boxes 400 and 500 may then be slidably adjusted with respect to one another to alter the length of latitudinal portion L1. As depicted, the end of the second latitudinal portion 502 may be closed for additional support.

Figure 6:
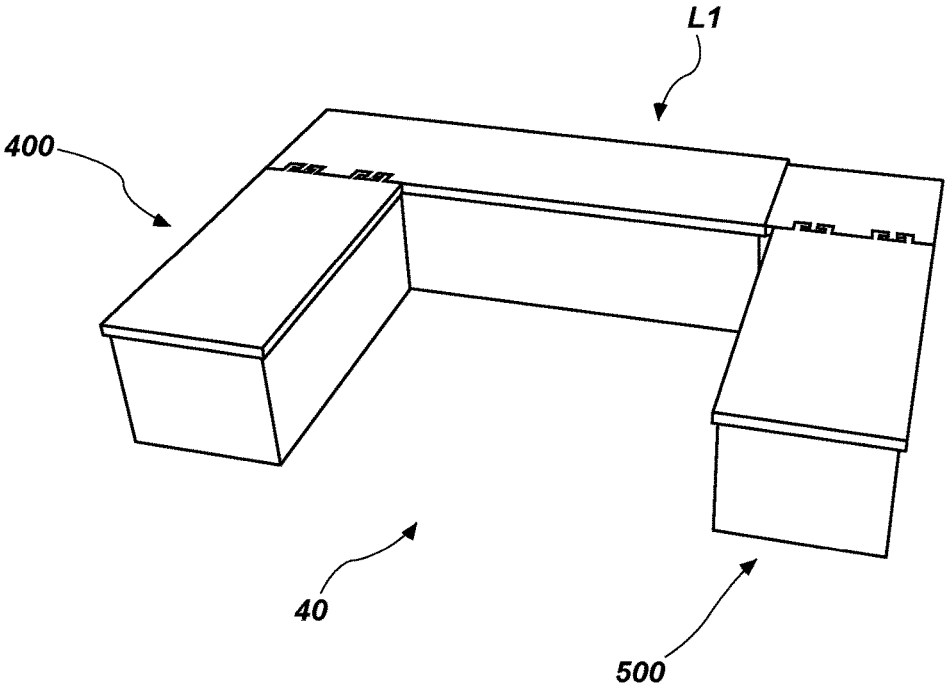
FIG. 6 is a top perspective view of the riser of FIGS. 4 and 5 in a collapsed position.

As with system 10, a vehicle may be positioned within the U-shaped riser system 40 and the two boxes 400 and 500 adjusted to place the riser system 40 adjacent to the vehicle for use. Similarly, when not in use, the riser system 40 may be reduced to a minimum space position by moving the boxes 400 and 500 towards one another until the latitudinal portion L1 is adjusted to the smallest possible length as depicted in FIG. 6. The riser system 40 may then be tipped onto the sidewall of a longitudinal portion 404 or 504. In a service bay, it could then be easily moved against a wall or into a storage area.

Figure 5:
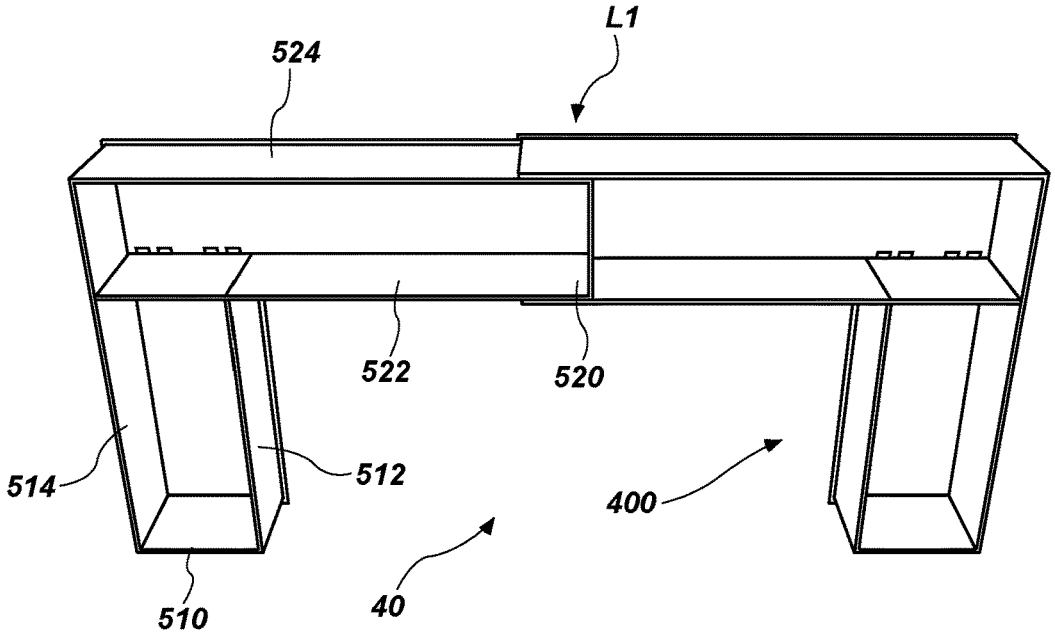
FIG. 5 is a bottom perspective view of the riser of FIG. 3.
Figure 7A:
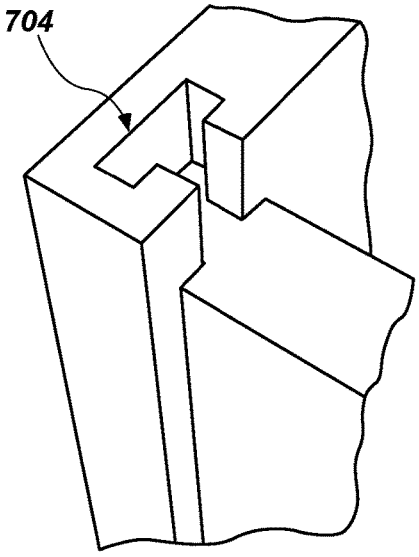
FIGS. 7A, 7B, and 8 are close views of connection joints of the riser of FIGS. 4 through 6.
Figure 7B:
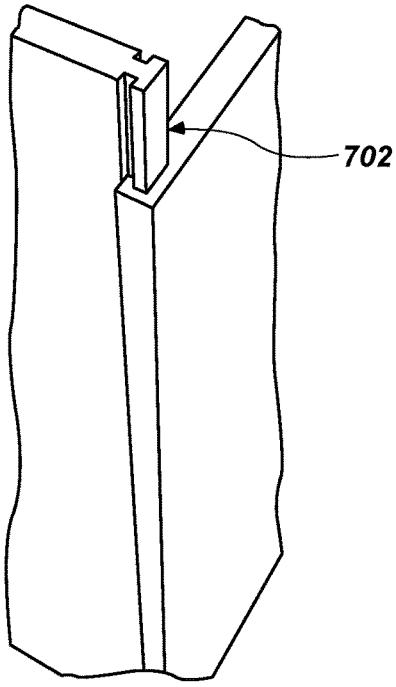

As best depicted in FIG. 5, each box 400 or 500 of the riser system 40 may be formed from a number of planar components, allowing it to be taken apart for longer storage or for ease of shipping. In the depicted embodiment, box 500 is formed from eight different components. An underlaying support frame is formed interconnecting pieces that form the sidewalls of the box 500. These may connect by tongue and groove joints, as depicted in FIGS. 7A and 7B, and discussed further herein or by corresponding slots allowing the pieces to be inserted together. A longitudinal end cap 510 may be attached to two longitudinal side wall pieces 512 and 514, which are then connected to two latitudinal sidewall portions 522 and 524, the other end of which may be closed by a latitudinal end cap 520. As depicted, the use of tongue and groove joints may allow for a shorter longitudinal sidewall 512, reducing the amount of material needed for the system 40. A longitudinal top cap 530 and latitudinal top cap 532 may then be placed over the support frame. The top caps 530 and 532 may be recessed or have an external lip to retain them in position when placed over the box frame. Box 400 may be similarly formed, with the omission of a latitudinal end cap.

FIGS. 7A and 7B depict one embodiment of a tongue and groove joint for joining the planar components together to form the supporting sidewalls of a box. A groove 704 which has a cross-section having an enlarged recess with a narrowed neck at the wall face may receive the end 702 of a member inserted therein that is shaped to correspond to the groove 704.

Figure 8:
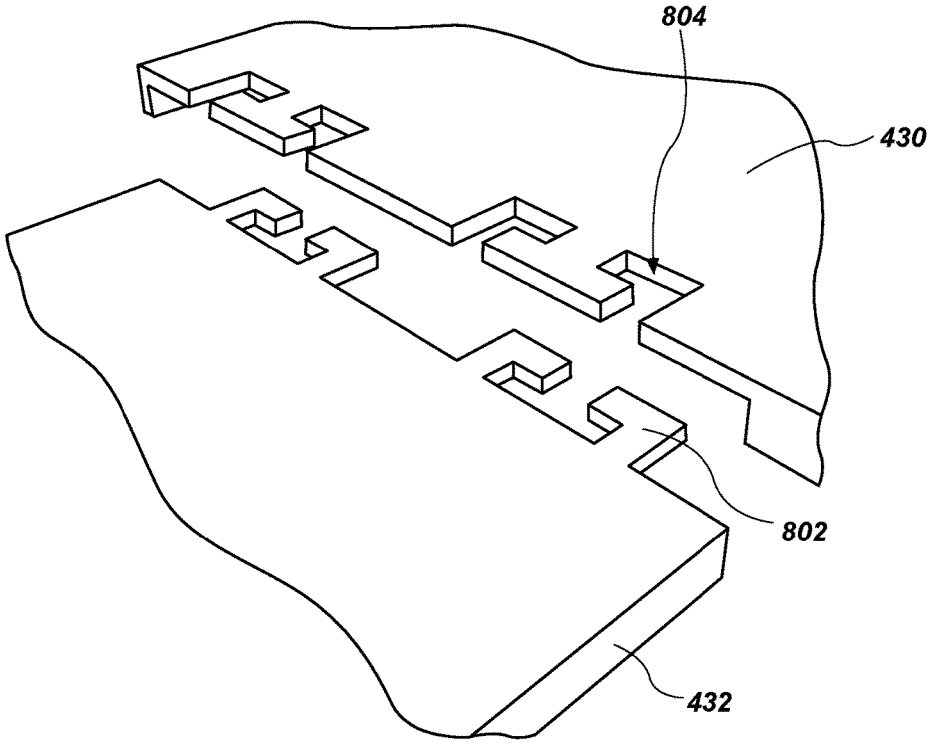

FIG. 8 similarly depicts a tongue and groove connection for maintaining the longitudinal and latitudinal top caps 432 and 430 to one another for additional stability. One or more "hooks" 802 may be received in corresponding recesses 804 from one cap to another to retain them in position to one another.

Figure 9:
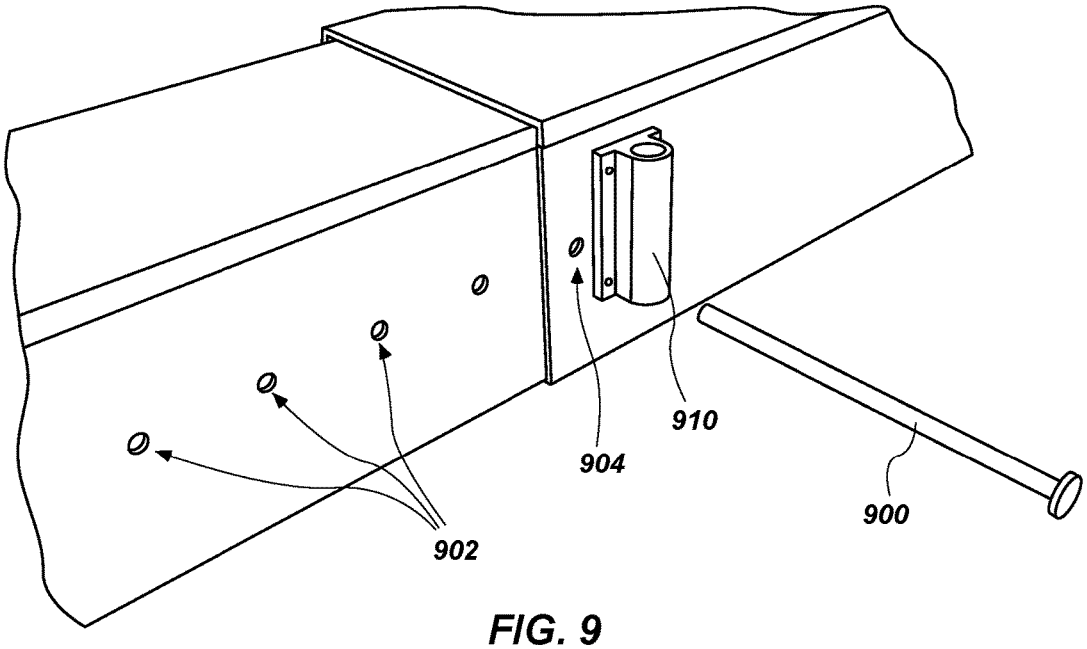
FIG. 9 is a front perspective view of the riser of FIGS. 4 through 8 depicting some additional components for adjustment and use.
Figure 10:
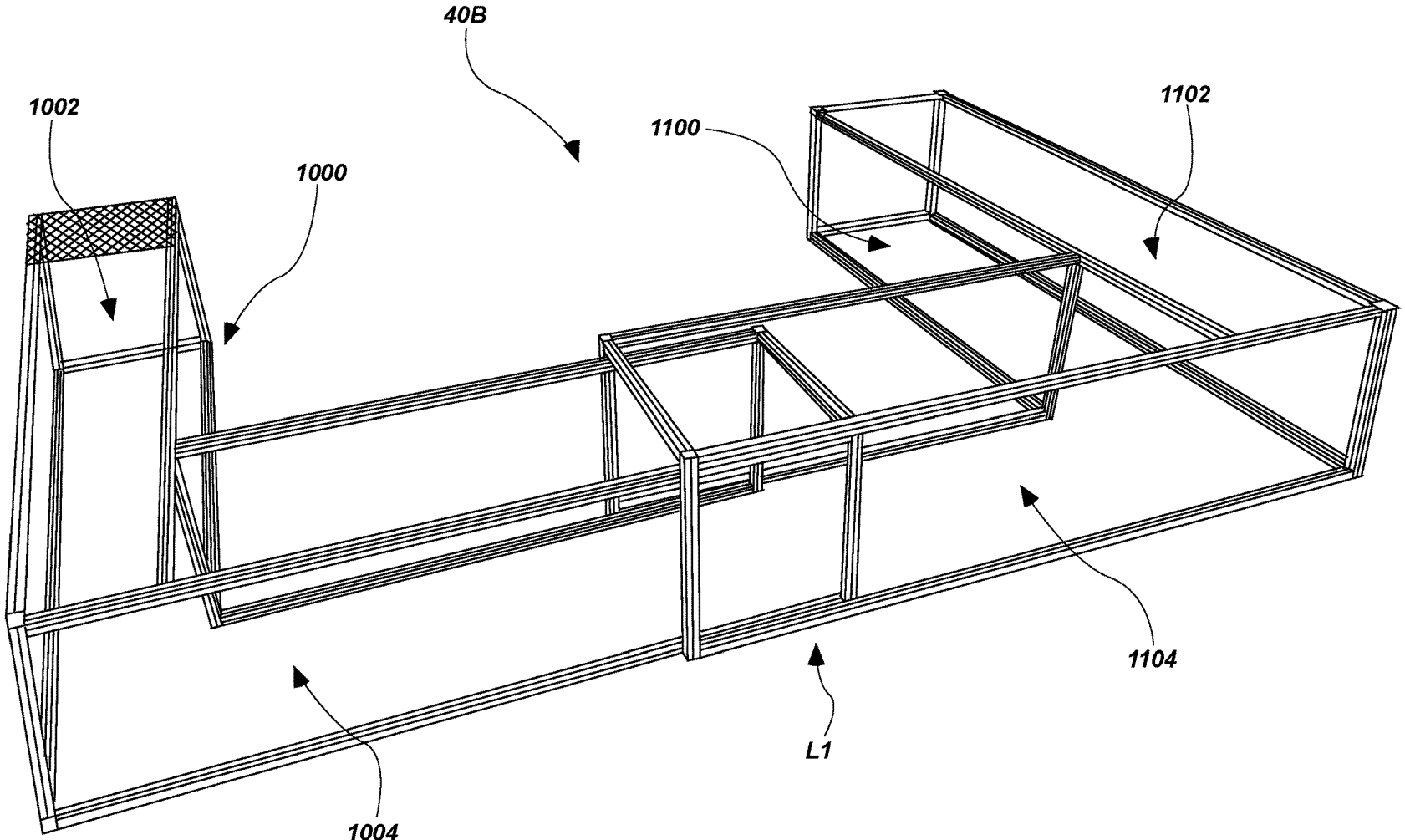
FIG. 10 is a front perspective view of a third embodiment of a riser in accordance with this disclosure in an assembled position.

Turning to FIG. 9, additional components for use with a system 10 or 40 are depicted. In order to maintain the system 40 in a desired adjusted position, a rod 900 may be used for placement in adjustment holes 902 and 904 placed in the sidewalls of the boxes 400 and 500. One or more pole retaining brackets 910, each formed as a tube attached to a flat base for attachment to the sidewall of a box 400 or 500, may be attached to the system. A pole for holding a light for illumination could then be placed therein and moved to a desired bracket as a vehicle is serviced.

It will be appreciated that the size of different embodiments of systems in accordance with the present disclosure may vary, as needed for use with different types of vehicles or in different settings. For example, shorter embodiments could be made for use with passenger vehicles or light trucks, and taller embodiments for use with SUVs and pickups. Larger versions could also be made for use with tractor-trailers, or heavy equipment.

The components for assembling a system in accordance with the present disclosure may be constructed from any suitable material having sufficient strength and durability for use in a shop setting. Such materials may include metals, polymers, and reinforced polymers, and may vary based on the particular setting and use intended.

Turning to FIGS. 10 through 14, a third embodiment of a riser system 40B for automotive repair is depicted. The generally U-shaped riser system 40B is formed from two generally L-shaped boxes 1000 and 1100. Each of the generally L-shaped boxes 1000 and 1100 may be constructed from metal framing and feature one or more open sides. This can reduce the weight and material used in construction. Use of framing with a generally square outer cross-section and a recessed groove may allow for ease of manufacture, but it will be appreciated that other framing, such as metal framing having a curved cross-section, may be used so long as the resulting structure has sufficient strength. For example, framing having a generally X-shaped interior portion with flanges to form the generally square outer section around grooves defined by the legs of the X shaped center, and a central bore running down the middle of the center may be used. it will be appreciated that in other embodiments, sufficiently stong plastic or wooden framing may be used.

A latitudinal portion L1 of the riser system 40A is formed from the adjustable joining of the latitudinal portions 1002 and 1102 of the two boxes 1000 and 1100 with the remaining longitudinal portions 1004 and 1104 of the Ls disposed in an orthogonal direction.

The adjustable joining allows the length of the latitudinal portion L1 to be adjusted. This may be accomplished by having the first box 1000 feature a latitudinal portion 1002 with an open end, into which the latitudinal portion 1102 of the second box 1100 may be inserted in a close fit. With this type of open frame embodiment, this may be accomplished by sizing the frames of the two boxes 1000 and 1100 appropriately. Boxes 1000 and 1100 may then be slidably adjusted with respect to one another to alter the length of latitudinal portion L1.

Figure 11:
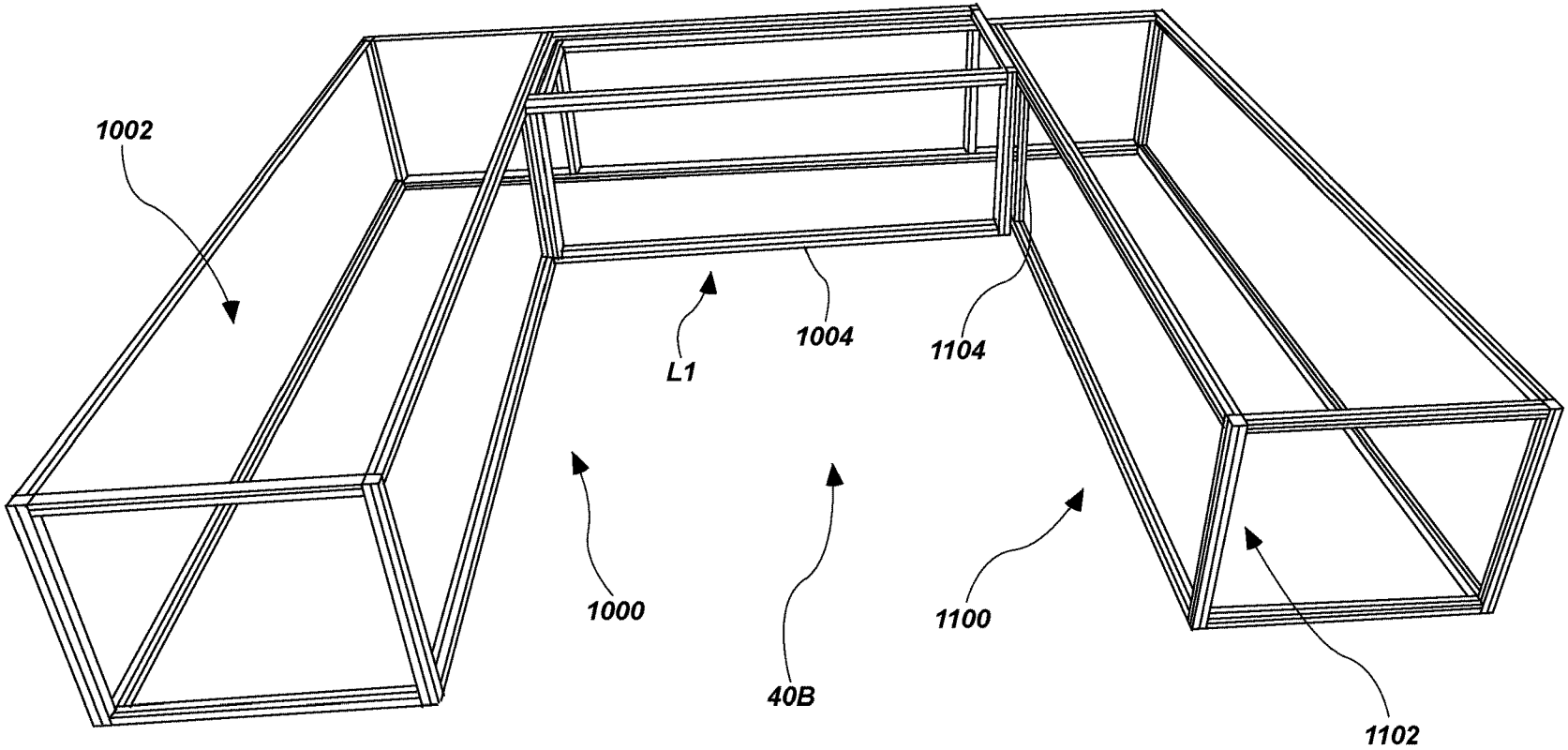
FIG. 11 is a rear perspective view of the riser of FIG. 10.

As with system 10 or system 40, a vehicle may be positioned within the U-shaped riser system 40B and the two boxes 1000 and 1100 adjusted to place the riser system 40B adjacent to the vehicle for use. Similarly, when not in use, the riser system 40B may be reduced to a minimum space position by moving the boxes 1000 and 1100 towards one another until the latitudinal portion L1 is adjusted to the smallest possible length as depicted in FIG. 11. The riser system 40B may then be tipped onto the sidewall of a longitudinal portion 1004 or 1104. In a service bay, it could then be easily moved against a wall or into a storage area.

Figure 11A:
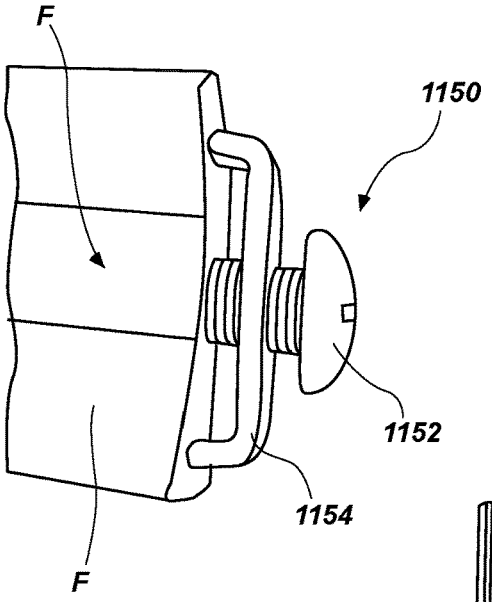
FIG. 11A is a side view of a fastener for connecting the components of the riser of FIGS. 10 and 11.
Figure 14:
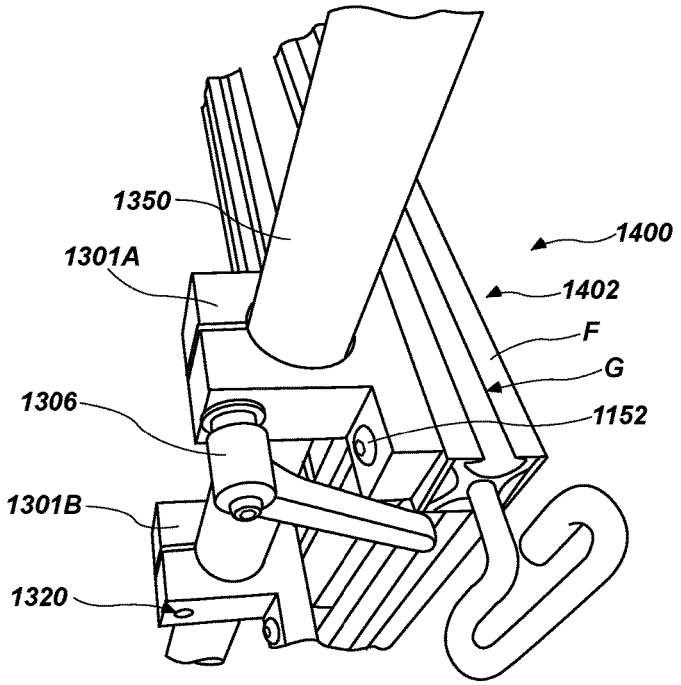
FIG. 14 is a side view of an accessory for with the riser of FIGS. 10 and 11

It will be appreciated that the use of metal framing with detachable joints to form each box 1000 or 1100 of the riser system 40B allows it to be taken apart for longer storage or for ease of shipping. In some embodiments, individual frame members F may be joined to one another using fasteners. As depicted in FIGS. 11A and 14, one suitable fastener assembly may be include a clip portion 1154 with enlarged ends that reside in the grooves G of the metal framing member F, with a screw 1152 that is threaded into a central bore of the member, which may pass through a hole bored in an adjacent member. Where the system 40B is shipped to a user as a set of precut and predrilled pieces, this allows a user to easily assemble the system, while reducing shipping costs.

Figure 12A:
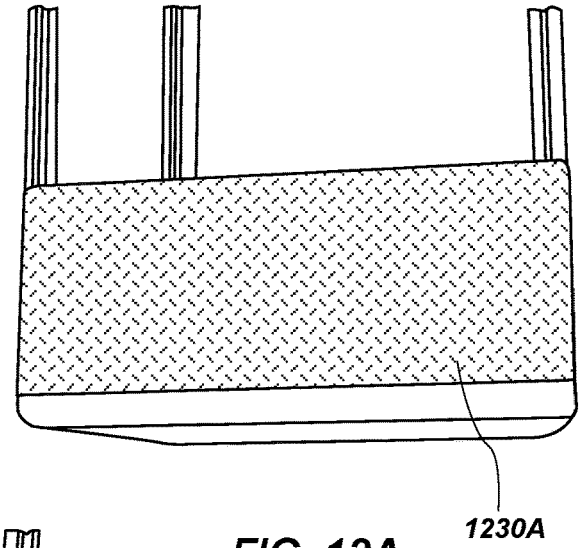
FIGS. 12A, 12B, 12C and 12D are close views of top panel and end portions for use with the riser of FIGS. 10 and 11.
Figure 12B:
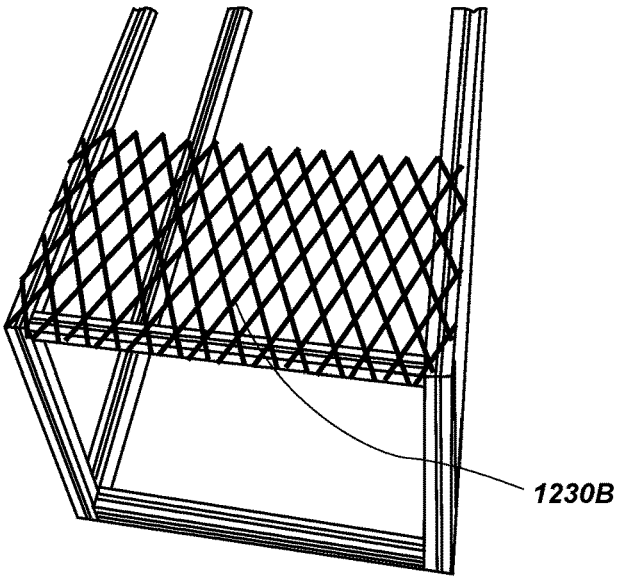

Removable top caps 1230A or 1230B depicted in FIGS. 12A and 12B may be placed over the support frame formed by a box 1000 or 1100 to form a top surface on which a user can stand or walk to perform work. Although only a small section top caps 1230A and 1232B is depicted, it will be appreciated that these are merely prototypes and the entire top surface of the boxes, or desired portions thereof, may be covered. The use of multiple pieces to cover the entire top portion may be desirable as it could allow for smaller packages for shipping or storage. The top caps 1230A or 1230B may be recessed or have an external lip to retain them in position when placed over the box frame. The external lip may be formed by a bend in the top cap 1230A or 1230B material, where a metal sheet is used to form the top cap.

Figure 12C:
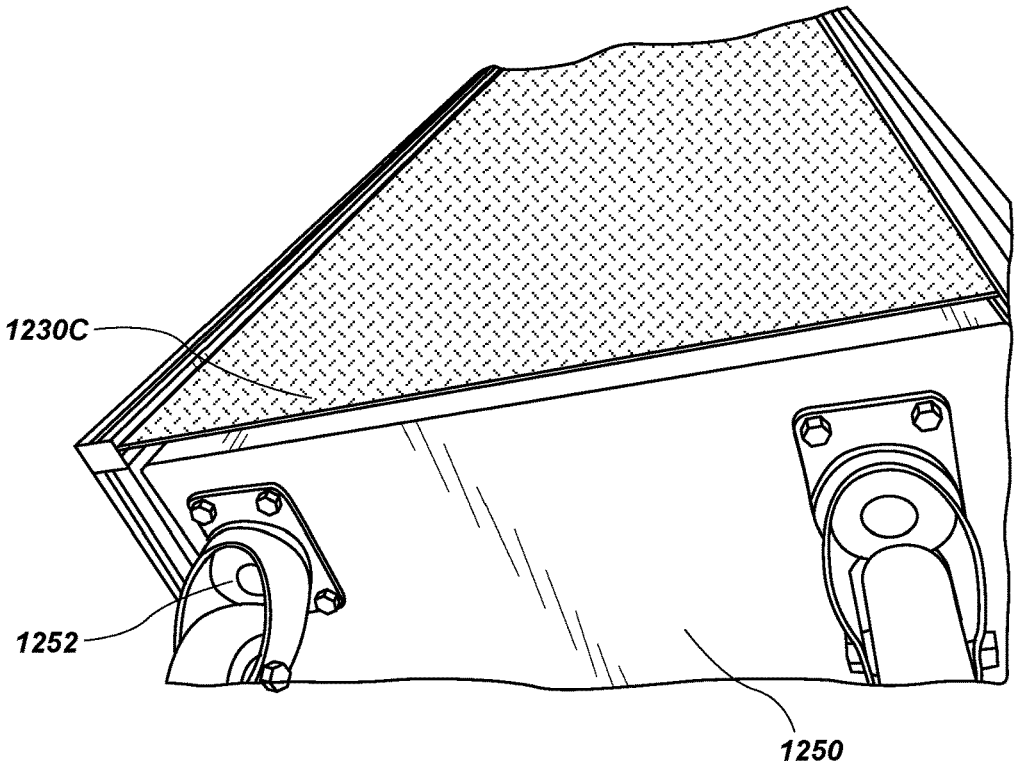
Figure 12D:
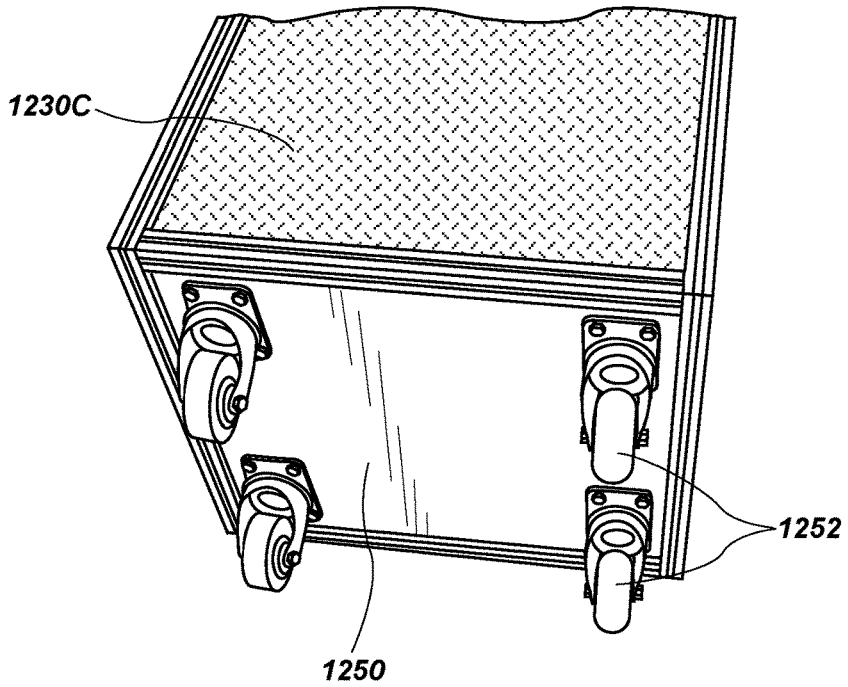

Alternatively, top cap 1230C depicted in FIGS. 12C and 12D, may be formed as a planar member which is placed into the grooves G of upper members of the support frame formed by a box 1000 or 1100 to form a top surface on which a user can stand or walk to perform work. As depicted, the top cap 1230C may have corners that are angled for easier insertion into the grooves G. Each box 1000 or 1100 may require two top cap 1230C pieces, one for the longitudinal portion and one for the latitudinal portion. In other embodiments, differing numbers of pieces may be used to cover the entire top portion. The use of planar members may allow for smaller packages for shipping or storage.

As depicted, a solid top cap 1230A or 1230C or one with multiple openings formed from a metal screen as depicted at 1230B may be used. This could allow for potential drainage and the desired top cap could be selected based on planned usage of the system 40B.

Further, as depicted in FIGS. 12C and 12D, end caps may be placed at the longitudinal face of each box 1000 or 1100 as endplates 1250. Each endplate 1250 may be formed as a planar member which is placed into the grooves G of four members of the support frame defining the longitudinal end of a box 1000 or 1100 to form an end surface. As depicted, an end cap 1250 may have corners that are angled for easier insertion into the grooves. A suitable number of casters 1252 may be attached to each endcap 1250. This allows for the assembly 40B to be easily moved by a user when it is tipped to stand on the ends. It may then be easily placed at the side of a service bay for storage until needed. Although four casters on an endplate are depicted, it will be appreciated that any suitable number may be used.

Figure 13A:
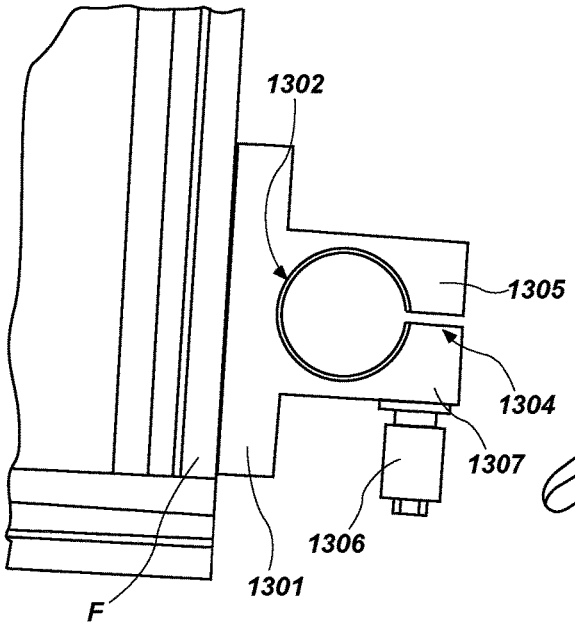
FIGS. 13A and 13B are top and perspective views of a connector for accessories that may be useful with the riser of FIGS. 10 and 11.
Figure 13B:
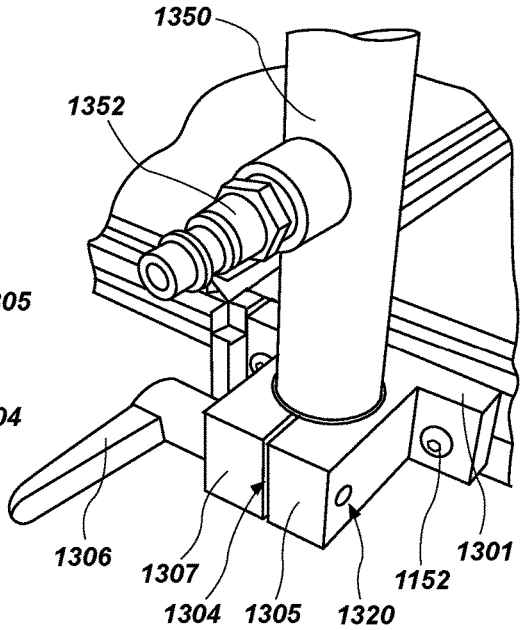

Turning to FIGS. 13A and 13B, additional components for use with a system 40B are depicted. One or more pole retaining brackets 1301 may be attached to the system by using suitable fasteners that allow for securing to the framing members. Each bracket 1301 may include a flat base for facing the framing member F and a body that extends outwards from the base. A central bore 1302 for insertion of a tube passes from a top end to a lower end of the body with a slit 1304 extending through the body from the bore to a sidewall to define two adjustable ends 1305 and 1307 that may be drawn together or moved apart to alter the size of the central bore 1302. An adjustment bore 1320 passes through the adjustable ends and allows a threaded member to be used to adjust the distance therebetween. A handle 1306 may be attached to the threaded member. A pole 1350 may be inserted in the bracket 1301 for holding a light for illumination or other features as desired (FIG. 13B). As depicted, in some embodiments, the pole 1350 may have a hollow bore and can be used as a conduit for com-pressed air for suitable tools. As depicted, a nozzle 1352 allows for connection of the conduit to a standard air hose connector. It will be appreciated that multiple brackets 1301 may be used, including by placement of brackets on side framing members and bottom framing members where multiple brackets on a single pole are desired for securing, as in FIG. 13A.

FIG. 14 depicts an upper assembly 1400 for adjustable connection to the pole 1350. As depicted, the assembly 1400 may include one or more brackets 1301A and 1301B as discussed previously herein, attached to a framework 1402 that may be built from framing members F, similar to the box 1000 or 1000 previously discussed herein. The framework 1402 may be used to support a tray for holding tools, a light fixture or other useful items for a user. The use of the brackets 1301A and 1301B allows for the assembly to be adjusted to a preferred height for an individual user or for a particular vehicle being serviced.

While this disclosure has been described using certain embodiments, it can be further modified while keeping within its spirit and scope. This application is therefore intended to cover any variations, uses, or adaptations of the disclosure using its general principles. Further, this application is intended to cover such departures from the present disclosure as come within known or customary practices in the art to which it pertains and which fall within the limits of the appended claims.

What is claimed is:

1. A riser for automotive repair, comprising a first generally L-shaped box having a latitudinal portion and a longitudinal portion, the first generally L-shaped box comprising a first framework including at least a first set of parallel framing members spaced apart from one another to define a first elongated portion of the first generally L-shaped box, and a second set of parallel framing members spaced apart from one another to define a second elongated portion of the first generally L-shaped box, and a first upper support surface defined by at least a first top cap disposed on the first framework and spanning the at least first set of spaced apart parallel framing members to form a first portion of an upper surface of the first generally L-shaped box, and a second upper support surface defined by a second top cap disposed on the first framework and spanning the second set of spaced apart parallel framing members to form a second portion of the upper surface of the first generally L-shaped box; a second generally L-shaped box having a latitudinal portion and a longitudinal portion, the second generally L-shaped box comprising a second framework including at least a third set of parallel framing members spaced apart from one another to define a first elongated portion of the second generally L-shaped box, and a fourth set of parallel framing members spaced apart from one another to define a second elongated portion of the second generally L-shaped box, and a third upper support surface defined by at least a third top cap disposed on the second framework and spanning the at least third set of spaced apart parallel framing members to form a first portion of an upper surface of the second generally L-shaped box, and a fourth upper support surface defined by a fourth top cap disposed on the second framework and spanning the fourth set of spaced apart parallel framing members to form a second portion of the upper surface of the second generally L-shaped box, wherein the first generally L-shaped box is adjustably joined to the second generally L-shaped box in a latitudinal direction with the longitudinal portions of each of the first generally L-shaped box and the second generally L-shaped box disposed parallel to one another; such that the first generally L-shaped box and the second generally L-shaped box may be positioned to adjust a latitudinal space between the longitudinal portions.

2. The riser of claim 1, wherein the first generally L-shaped box is adjustably joined to the second generally L-shaped box, by insertion of the latitudinal portion of the first generally L-shaped box into an open end on the latitudinal portion of the second generally L-shaped box.

3. The riser of claim 2, wherein the two boxes may be positioned to adjust the latitudinal space between the longitudinal portions by adjustment of a distance the latitudinal portion of the first generally L-shaped box is inserted into the open end of the latitudinal portion of the second generally L-shaped box.

4. The riser of claim 1, wherein the framing members comprise elongated members having a rectangular cross section and having grooves on at least two long sides of the framing members.

5. The riser of claim 4, wherein the framing members comprise at least one metal framing member.

6. The riser of claim 4, wherein the at least first top cap comprises a planar member inserted into the grooves on the framing members defining an upper portion of the first generally L-shaped box.

7. The riser of claim 1, further comprising at least one end cap enclosing a longitudinal end surface of the first generally L-shaped box.

8. The riser of claim 7, wherein the at least one end cap comprises a planar member inserted into opposite grooves on parallel framing members defining the longitudinal end of the first generally L-shaped box.

9. The riser of claim 8, further comprising at least one caster attached to the at least one end cap.

10. The riser of claim 1, wherein the at least first top cap comprises a solid planar member.

11. The riser of claim 1, further comprising at least one attachment bracket for connection to a framing member of one of the frameworks and to a pole for supporting an accessory above the riser.

12. The riser of claim 11, wherein the at least one attachment bracket comprises a body with a base for attachment to the framing member and a central bore for insertion of the pole, wherein the size of the bore is adjustable.

13. A system for supporting a user for automotive repair, comprising a first framework defining a first generally L-shaped box having a latitudinal portion and a longitudinal portion, the first framework including at least a first set of parallel framing members spaced apart from one another to define a first elongated portion of the first generally L-shaped box, and a second set of parallel framing members spaced apart from one another to define a second elongated portion of the first generally L-shaped box, wherein an end side of the latitudinal portion defines an open end;

a first upper support surface defined by at least a first top cap disposed on the first framework and spanning the at least first set of spaced apart parallel framing members to form a first portion of an upper surface of the first generally L-shaped box, and a second upper support surface defined by a second top cap disposed on the first framework and spanning the second set of spaced apart parallel framing members to form a second portion of the upper surface of the first generally L-shaped box;

a second framework defining a second generally L-shaped box having a latitudinal portion and a longitudinal portion, the second framework including at least a third set of parallel framing members spaced apart from one another to define a first elongated portion of the second generally L-shaped box, and a fourth set of parallel framing members spaced apart from one another to define a second elongated portion of the second generally L-shaped box, wherein a latitudinal end of the second generally L-shaped box can be inserted in the open end of the latitudinal portion of the first generally L-shaped box with the longitudinal portions of the first generally L-shaped box and the second generally L-shaped box disposed parallel to one another to join the first generally L-shaped upper surface to the second generally L-shaped upper surface; and a third upper support surface defined by at least a third top cap disposed on the second framework and spanning the at least third set of spaced apart parallel framing members to form a first portion of an upper surface of the second generally L-shaped box, and a fourth upper support surface defined by a fourth top cap disposed on the second framework and spanning the fourth set of spaced apart parallel framing members to form a second portion of the upper surface of the second generally L-shaped box.

14. The system of claim 13, wherein the first top cap comprises at least a first planar member extending over the latitudinal portion and second planar member extending over the longitudinal portion.

15. The system of claim 14, wherein a latitudinal space between the longitudinal portions of the first generally L-shaped box and the second generally L-shaped box may be adjusted by adjustment of a distance the latitudinal portion of the first generally L-shaped box is inserted into the open end of the latitudinal portion of the second generally L-shaped box.

16. The system of claim 14, wherein the first top cap comprises a planar member inserted into grooves on the at least first set of parallel framing members.

17. The system of claim 14, further comprising at least one end cap enclosing a longitudinal end surface of the first generally L-shaped box and at least one caster attached to the at least one end cap.

18. The riser of claim 14, wherein the first top cap and second top cap are formed from a unitary planar member.

* * * * *